United States Patent [19]

Jones

[11] 4,078,605

[45] Mar. 14, 1978

[54] RISER PIPE STRING

[75] Inventor: Marvin R. Jones, Houston, Tex.

[73] Assignee: Cameron Iron Works, Inc., Houston, Tex.

[21] Appl. No.: 771,997

[22] Filed: Feb. 25, 1977

[51] Int. Cl.[2] ..... E21B 33/035

[52] U.S. Cl. ..... 166/.5; 175/7; 61/54; 61/102

[58] Field of Search ..... 166/.5; 175/7–10; 61/54, 5, 102

[56] References Cited

U.S. PATENT DOCUMENTS

| | | | |
|---|---|---|---|
| 2,994,201 | 8/1961 | Hutchings | 61/5 |
| 3,352,118 | 11/1967 | Burkhardt | 61/102 |
| 3,410,096 | 11/1968 | Schuh | 175/7 |

*Primary Examiner*—James A. Leppink

[57] ABSTRACT

There is disclosed a riser pipe string made up of riser pipe sections each comprising a pipe length and a fairing carried by the pipe for free rotation thereabout.

18 Claims, 3 Drawing Figures

Figure 1:
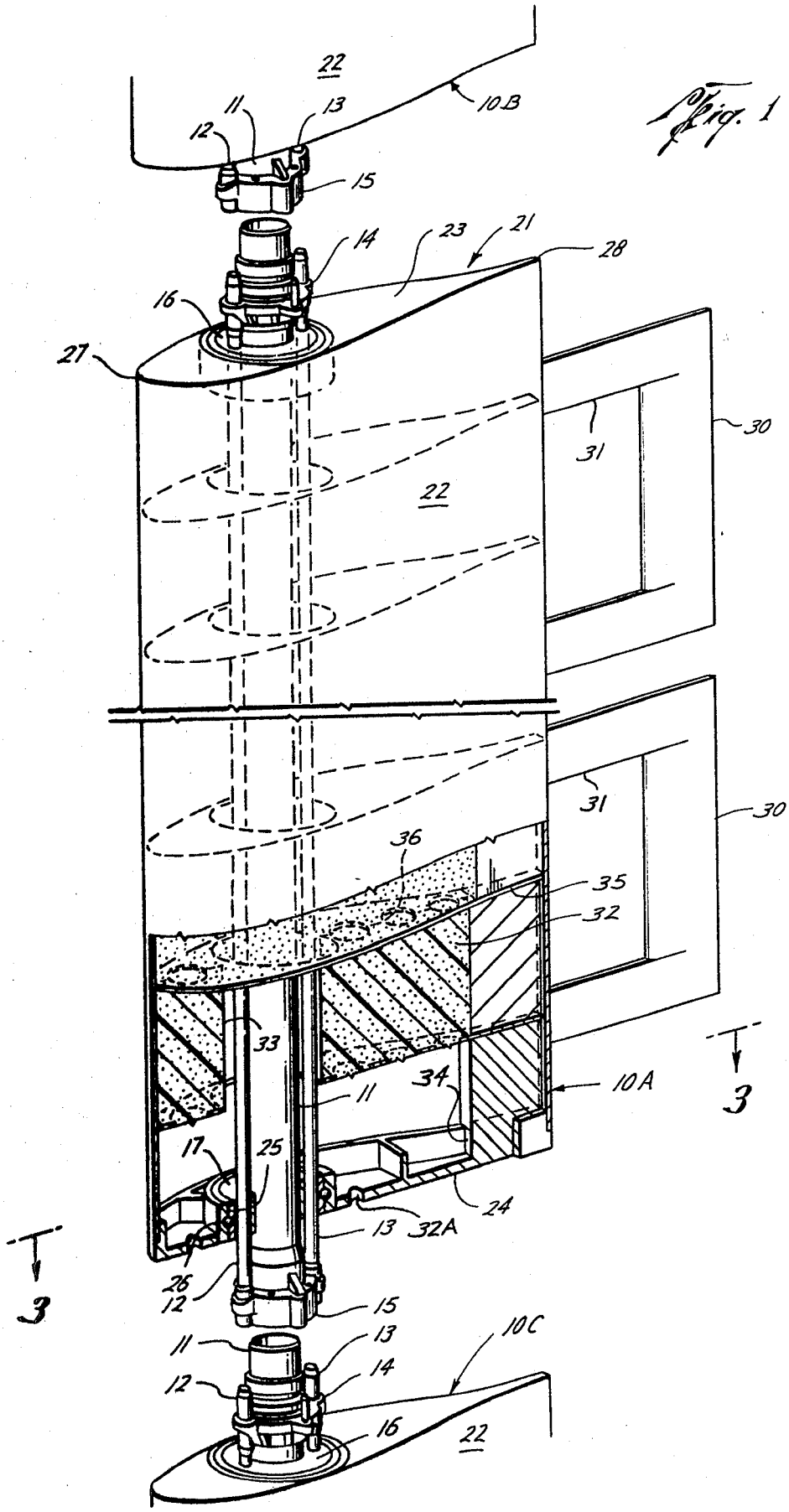

22
10B
11
13
12
15
14
23
21
28
16
27
30
31
22
30
31
36
35
32
33
34
10A
3
11
17
25
24
13
32A
26
12
15
3
11
13
10C
14
12
16
22

RISER PIPE STRING

This invention relates to improvements in riser pipe strings which extend generally vertically between a blowout preventer stack on an underwater wellhead and a drilling structure at the water surface.

As well known in the art, riser pipe strings permit drilling pipe strings to be lowered into and raised from the well and provide a conduit through which drilling fluid may be returned to the drilling structure during drilling operations. As offshore wells are drilled in water of ever-increasing depths, bending stresses in the riser pipe string provide less and less resistance to lateral forces resulting from water current drag.

Although these forces are a problem in the case of any underwater pipe string, they are a particular problem in the case of a riser pipe string not only because of the large diameter of the riser pipe, but also because the string usually includes, in addition to the riser pipe, at least two and often more tubular strings extending parallel to the riser pipe. It is conventional practice for choke and kill lines to extend downwardly with the riser pipe for connection to the blowout preventer stack.

In order to limit the angular deflections of the upper and lower ends of the riser pipe and to provide required resistance to lateral forces, it is common practice to use apparatus for adding axial tension to the riser pipe string. However, when the drilling structure is a floating vessel, the tensioning apparatus must accommodate considerable heave due to wave action. Furthermore, this is an expensive procedure and causes the vessel to sink lower into the ocean so that currents produce larger lateral forces on the vessel's hull. Still further, the lateral forces due to current drag require some means for resisting them whether the drilling structure is a floating vessel or a platform fixed to the subsurface level. Additionally, longer riser pipe strings are subject to greater drag forces which must be resisted by more tension.

It has been proposed to reduce the drag forces on underwater, vertically extending members such as pipes by means of fairings comprising bodies having streamlined forms which rotate freely about the member into positions substantially aligned with the water current. However, riser pipe strings require special fairing constructions due to the extension of choke and kill lines along the length thereof, and I am not aware of fairing bodies designed for this purpose which are of such form as to materially reduce the drag forces thereon.

An object of this invention is to provide a riser pipe string having a fairing of such construction as to materially reduce the current drag forces thereon.

Another object is to provide a riser pipe string of the character above described wherein the fairing has a buoyant effect for further controlling the bending stress therein; and, more particularly, wherein the fairing is so constructed as to provide a buoyant effect without imposing bending moments on the string.

A further object is to provide such a riser pipe string having such a fairing which is of relatively simple construction and relatively inexpensive to manufacture.

These and other objects are accomplished, in accordance with the illustrated embodiment of the present invention, by a riser pipe string which includes sections each having a fairing including a body of streamlined form which, in order to permit its size and weight to be reduced to a minimum, is rotatably carried about the riser pipe at its widest portion. With bodies having streamlined forms of the type contemplated by this invention, this locates the axis of rotation of the fairing body rearwardly of the hydrodynamic center of the body; and, in order to prevent the fairing from turning crosswise of the current, or turning in the wrong direction, and instead cause it to assume a position in which the chord from its leading to its trailing end is substantially aligned with the direction of water current, the fairing also includes at least one vane extending rearwardly from the trailing end of the body in substantial alignment with its chord so as to move the effective hydrodynamic center rearwardly of its axis of rotation.

The fairing body, which preferably extends from substantially one end to the other of the pipe, has spaces therein for containing a substance, such as a foamed plastic material, which is less dense than water so as to provide a buoyant effect. Due to the above-described arrangement of the fairing body in which its widest portion receives the riser pipe a substantial distance rearwardly of the hydrodynamic center of the body, it's possible to contain the substance within spaces on the front and rear sides of the pipe joint which are of such size and so arranged as to avoid inducing moments about the vertical center of the fairing.

Figure 2:
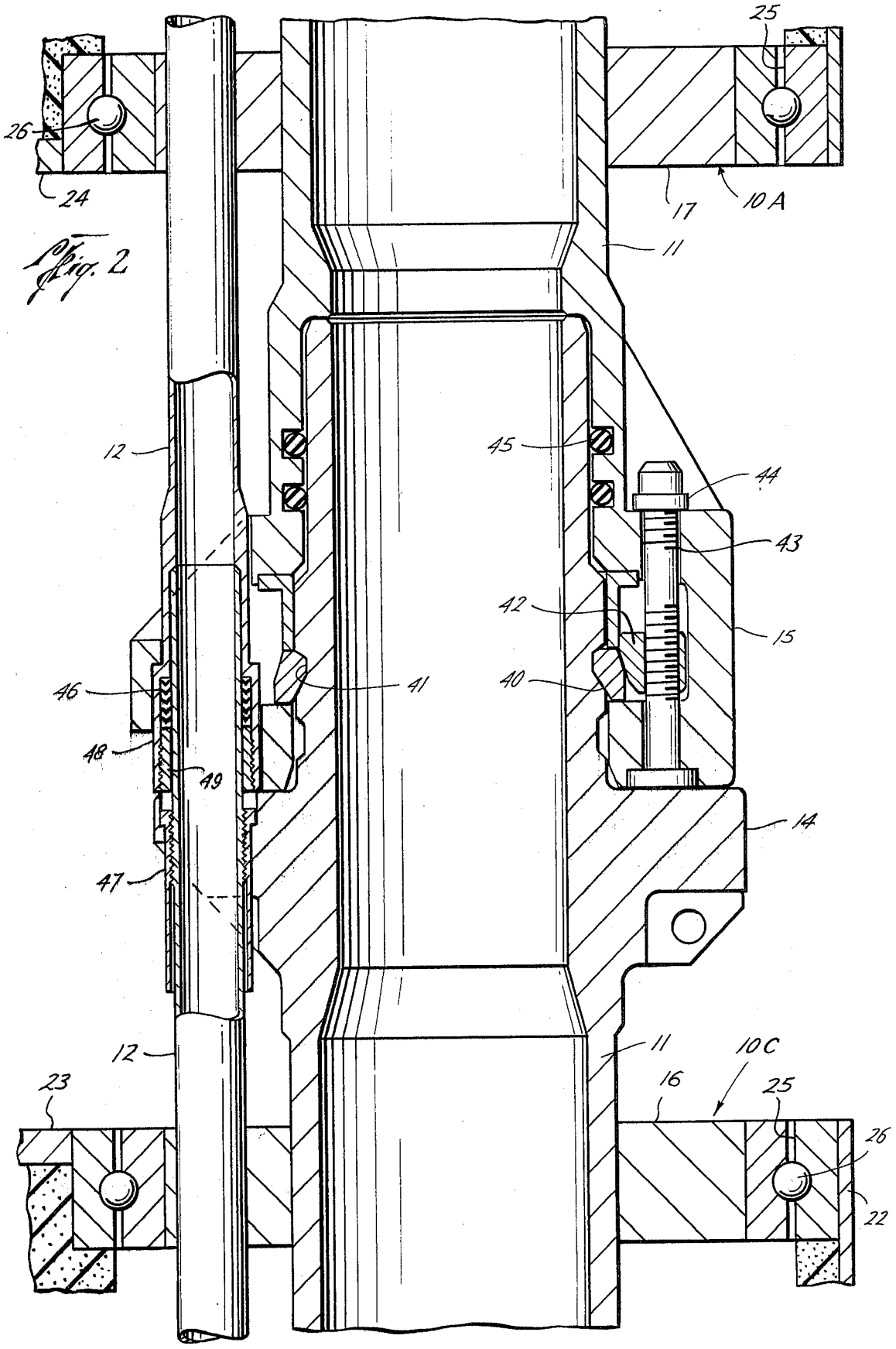
Figure 3:
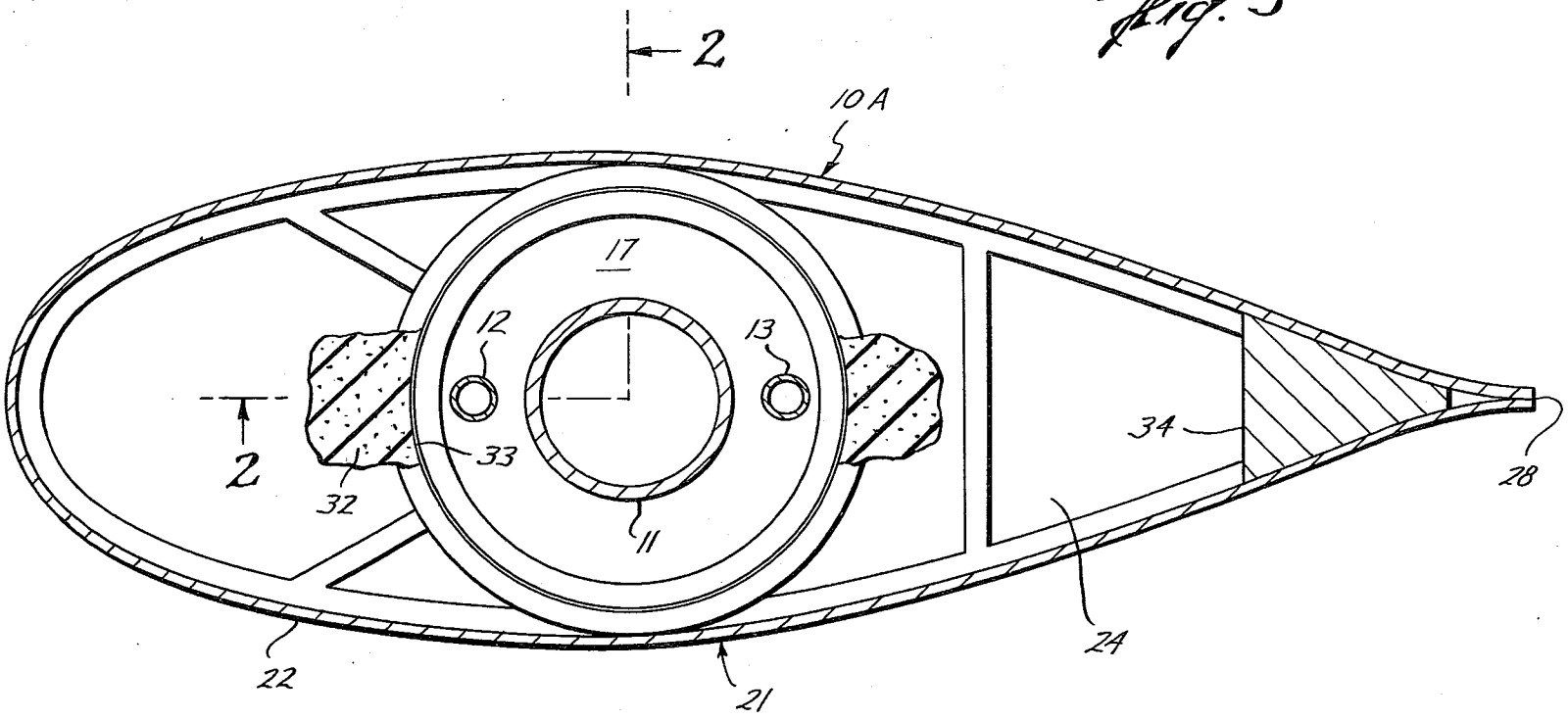

As previously described, each section of a riser pipe string also normally includes at least a pair of tubular members extending generally parallel to the pipe, one of which is connectible as part of a kill line and the other as part of a choke line. Preferably, each such tubular member extends through longitudinally spaced flanges mounted on the pipe, and the fairing body has openings in its opposite ends which are rotatably mounted on the flanges. The foamed plastic material extends lengthwise from one flange to the other of the hollow body and has a bore therethrough which is slightly larger than the flanges so as to permit the fairing body to be assembled thereover. In the drawings:

FIG. 1 is an exploded isometric view of a portion of a riser pipe string including a center riser pipe section whose opposite ends are shown disconnected from the ends of adjacent upper and lower sections, the lower part of the body of the fairing for the center section being shown in vertical section and having portions thereof broken away for purposes of clarity;

FIG. 2 is an enlarged vertical sectional view of a portion of the riser pipe string, as seen along broken lines 2—2 of FIG. 3, showing the connection of the lower end of the center riser pipe section to the upper end of the lower riser pipe section; and FIG. 3 is an enlarged cross-sectional view of the center riser pipe section, as seen along broken line 3—3 of FIG. 1, with the foamed plastic contained within the fairing body broken away for purposes of clarity.

With reference now to the details of the above-described drawings, the portion of the riser pipe string shown in FIG. 1 includes a center riser pipe section 10A having its upper and lower ends disconnected from adjacent upper and lower riser pipe sections 10B and 10C, respectively. Each riser pipe section may be approximately 50 feet in length, so that section 10A is shown to be discontinued intermediate its upper and lower ends, and the overall riser pipe string may be from several hundred to several thousand feet in length and thus comprised of a large number of riser pipe sections in addition to those shown in FIG. 1. The lower end of the lowermost section of the riser pipe string is ordinarily connected to a ball joint at the upper end of the blowout preventer stack, and the upper end of the uppermost section thereof is ordinarily suspended from a drilling platform which may be a floating vessel at the water level.

Each riser pipe section may be identical to section 10A, which, as shown in FIG. 1, comprises a pipe 11 connectible at its opposite ends to pipes of adjacent sections and tubular members 12 and 13 extending parallel to pipe 11 for connection at their opposite ends to similar members of the adjacent sections. When so connected, the pipes make up the riser pipe which forms an upward continuation of the bore through the preventer stack to receive a drilling string, and the tubular members make up choke and kill lines having their lower ends fluidly connected to the bore of the preventer stack. The upper ends of members 12 and 13 are received within a collar 14 about an upper portion of the pipe, and the lower ends thereof are received within a collar 15 about a lower portion thereof.

Although a riser pipe string ordinarily includes such choke and kill lines, this invention contemplates, in accordance with its broader aspects, that the string may include only the riser pipe. On the other hand, it also contemplates that the string may include one or more strings to be used for other purposes. In any event, the upper ends of riser pipe 11 and tubular members 12 and 13 of each riser pipe section have male portions and the lower ends thereof female portions adapted to be telescopically interfitted to permit them to be connected in end-to-end relation and sealed with respect to one another, as will be described below in connection with FIG. 2.

An upper flange 16 is mounted on riser pipe 11 just beneath collar 14, and a lower flange 17 is mounted thereon just above collar 15. As shown, each flange is concentric with the riser pipe and has holes therein through which tubular members 12 and 13 extend. Tubular members 12 and 13 are arranged on diametrically opposite sides of the riser pipe.

Each riser pipe section also comprises a fairing 21 including a body 22 carried by the pipe for free rotation about it. Body 22 is hollow and has upper and lower end walls 23 and 24, respectively, in which openings 25 are formed for disposal about upper and lower flanges 16 and 17. Thus, opening 25 in upper wall 23 closely surrounds the outer circumference of flange 16, while opening 25 in the lower end wall 24 closely surrounds the outer circumference of flange 17. Ball bearings 26 are carried in races provided on the inner and outer circumferences of the body end walls and flanges so as to facilitate free rotation of the body.

As previously mentioned, the riser pipe extends through the widest portion of the thickness of the fairing body, with the hydrodynamic center of the body forward of its axis of rotation. As also previously described, however, the fairing also includes several vanes 30 which are connected to the trailing edge of the body by means of arms 31 for extension rearwardly thereof in general alignment with its chord lengths so as to shift the effective hydrodynamic center of the fairing downstream of the axis of rotation, thereby insuring that the fairing swings into and remains in minimum current drag position. As shown in FIG. 1, the vanes are spaced longitudinally of the fairing body, and, in order to minimize frictional drag, each vane is relatively thin.

The efficiency of a particular form or body cross section in reducing drag is a function of its drag coefficient ($C_d$). As used herein, "streamlined" means a form or cross section (having a $C_d$ based on its area normal to the water current) of no greater than 0.1 at a Reynods number ($R_n$) equal of $3 \times 10^6$. Although drag coefficients vary with the angle of attack of the body with respect to the relative motion of the body and fluid in which it's disposed, it may be assumed that the angle of attack is zero due to the ability of the fairing body of the present invention to align itself with the water current.

The drag coefficients of many forms have been determined experimentally, and it is within the skill of the art to predict the drag coefficients of other, similar forms. Drag coefficients of forms used to streamline wires or the like having constant cross sections are based on the area above noted — i.e., normal to relative movement of the fluid in which the form is disposed. When known coefficients are instead calculated on the basis of the area of a plane passing through the chord and axis of the body, as is the case with wings, they may be converted to coefficients as contemplated above by multiplying them by the ratio of the chord to the thickness of the body.

Forms having a $C_d$ no greater than the value indicated, and thus "streamlined" in the sense contemplated by the present invention, usually have a maximum thickness at a point located thirty to fifty percent of the distance along their chords rearward of their leading edges. In the streamlined form best shown in FIG. 3, the maximum thickness is located 25 percent of distance along its chord, and its axis of rotation is located about 40 percent therealong.

In the contemplated range of Reynolds numbers, the hydrodynamic center, which is a point along the chord of a form selected so that the coefficient of moment about the point will be independent of the angle between the chord line and the relative motion of the water, is located very close to one-fourth of the distance from the leading edge to its trailing edge of forms whose thickness is one-sixth to one-third of its chord. In the case of thinner forms, the hydrodynamic center will be forward of this point — i.e., less than 25% of the distance from its leading edge.

Thus, as previously noted, with the riser pipe extending through the widest portion of the fairing body, its axis and thus the axis of rotation of the body is rearward of the hydrodynamic center of the body. Consequently, if it were not for the novel fairing construction of the present invention, which moves its effective hydrodynamic center rearwardly of this axis, the fairing would not automatically align itself with the water current.

Other factors affecting the efficiency of a streamlined form are the ratio of its thickness at its widest portion to its chord or length and the distribution of its thickness along the length of its chord. The form of the fairing body 21 which is best shown in FIG. 3 has a thickness distribution corresponding to that of a known air foil section described in a U.S. Deparment of Commerce publication N.A.S.A. TND-7328. However, as compared with this known form which has a thickness to chord ratio of 17%, the fairing body 21 has a ratio of 30%, which is believed to minimize drag for a body with uniform thickness along its length. Also, this increased thickness provides a fairing body in which the spaces forwardly and rearwardly of the riser pipe are more nearly equal in volume and thus more readily adaptable to containing a substance fore and aft of the pipe in such a manner as to provide the desired buoyant effect.

Based on the foregoing, I am able to predict that the $C_d$ of fairing body 21 is about 0.035, which of course is well below the minimum contemplated by the above-noted definition of "streamlined". By comparison, a tube or cylinder such as a riser pipe, without fairing, has a $C_d$ of about 0.85, and a fairing having a body form consisting of a cylinder with a trailing edge having an included angle at its trailing end of about 0.45. The relatively minor affect of a fairing of this latter construction will be appreciated when it is realized that a certain percentage, normally about 12.5, of the overall length of the riser string consists of connections between adjacent ends of the riser pipe, so that only about 87.5% thereof can be conveniently faired. As a result, a fairing of this latter type would reduce drag only about 40%, while a fairing constructed in accordance with the present invention would reduce it about 80%. Put another way, the drag force on a riser so faired would be about three times that on the riser of the present invention.

Holes 32A are formed in the lower end wall 24 of each body to permit water pressure to equalize across the interior and exterior thereof. In the preferred and illustrated embodiment of the invention, however, the volume of water within the spaces on the front and rear sides of the pipe is reduced by a substance, such as foamed plastic material 32, which is less dense than water and thus provides the body with a buoyant effect. As shown by a broken away portion of the fairing body in FIG. 1, this foamed plastic material extends from one end wall to the other (the portion thereof just above bottom wall 24 of section 10A being removed in FIGS. 1 and 3 for illustrative purposes), and has a bore 33 formed therein of a size substantially equal to that of openings 25 in the end walls. In this way, the fairing body may be easily assembled over the flanges on the pipe joint and ball bearings 26 then moved into place between their races, in a manner well known in the art.

These spaces on the front and rear sides of the pipe are of such size and so arranged that the buoyant effect provided by the plastic material will substantially avoid producing moments about the axis of the fairing body. As shown in FIGS. 1 and 3, the size and arrangement of the rear space may be adjusted, as required, by means of inserts mounted adjacent the trailing edge of the body. As will be appreciated, these inserts also serve to strenghten the body at its thinnest point.

The hollow body 22 is braced by struts 35 secured to the curved side walls of the body at spaced locations therealong and having openings therein aligned with the openings 25 in the end walls of the body. As shown in FIG. 1, these struts have holes 36 therein to lighten their weight and also facilitate filling of the body with foam material 32 from one or both ends thereof. As also shown in FIG. 1, inserts 34 may be made of separate sections to be arranged intermediate the end walls and struts of the body.

Although opposite ends of the riser pipe and tubular members of each riser pipe section may be connected and sealed with respect to the ends of the riser pipe and tubular members of adjacent riser pipe section in any suitable manner, a preferred connection and seal arrangement is shown in detail in FIG. 2. Thus, with the lower female portion of pipe joint 11 of riser pipe section 10A telescopically lowered over the upper male portion of pipe joint 11 of riser pipe section 10C, and collar 15 landed on collar 14, a split locking ring 40 carried by collar 15 is located opposite a locking groove 41 about collar 14. The locking ring 40 is circumferentially constricted into locking position within groove 41 by means of cams 42 which are guidably movable vertically within an annular recess in collar 15.

Each cam is threadably received about a threaded pin 43 carried by collar 15, so that, upon rotation of the pin in one direction, cam 42 is moved downwardly to force the locking ring to locking position, and, upon rotation of the pin in the opposite direction, the cam is raised to permit the ring 40 to expand to unlocking position. Each pin has a head 44 on its upper end for manipulation in any suitable manner. When the lower end of pipe 11 of section 10A has been lowered telescopically over the upper end of pipe 11 of section 10C, it is sealed with respect thereto by seal rings 45.

As the pipes move into telescopic relation, the lower ends of the tubular members 12 and 13 of section 10A are telescopically fitted over the upper ends of the tubular members of the adjacent section 10C. Each lower end is sealed with respect to each upper end by means of a seal carried by the male portion of the lower end, as shown by seal 46 carried by member 12 in FIG. 2. The upper end of each member is supported on an annular shoulder within collar 14 by a nut 47, and an enlargement 48 on each lower end is held tightly against an annular shoulder within collar 15 due to the make up of nut 47. Seal 46 is carried within enlargement 48 and held in place by nut 49.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A riser pipe section, comprising a pipe of circular cross section connectible as part of a riser pipe string which is adapted to extend between an underwater wellhead and a structure thereabove, and a fairing including a body which is streamlined in cross section and whose widest portion is rotatably mounted about the pipe, the hydrodynamic center of the body being intermediate its leading edge and the axis of its rotation, at least one vane extending rearwardly from the trailing end of the body in substantial alignment with the chord of the body, so as to move the effective hydrodynamic center of said body downstream of said axis, whereby said body will assume a position about the pipe in which its chord is substantially aligned with the direction of water current.

2. A riser pipe section of the character defined in claim 1, wherein the fairing body extends from substantially one end to the other of the pipe.

3. A riser pipe section of the character defined in claim 1, wherein the fairing body has spaces therein for containing a substance whose density in less than that of water.

4. A riser pipe section of the character defined in claim 3, wherein said spaces are of such size and so arranged on the front and rear sides of the pipe that the substance contained therein will substantially avoid including moments about the axis of the fairing body.

5. A riser pipe section of the character defined in claim 3, wherein a foamed plastic material is contained within said spaces.

6. A riser pipe section of the character defined in claim 5, wherein said spaces are of such size and so arranged on the front and rear sides of the pipe that the plastic material contained therein will substantially avoid producing moments about the axis of the fairing body.

7. A riser pipe section, comprising a pipe of circular cross section connectible as part of a riser pipe string which is adapted to extend between an underwater wellhead and a structure thereabove, longitudinally spaced flanges mounted on the pipe, at least one tubular member extending through the flanges for connection as part of a tubular string which is adapted to extend parallel to the riser pipe string, and a fairing including a body which is generally streamlined in cross section and whose widest portion has end openings therein which are rotatably mounted about the flanges, the hydrodynamic center of the body being intermediate its leading edge and the axis of its rotation, and at least one vane extending rearwardly from the trailing end of the body in substantial alignment with the chord of the body, so as to move the effective hydrodynamic center of said body downstream of said axis, whereby said body will assume a position about the pipe in which its chord is substantially aligned with the direction of water current.

8. A riser pipe section of the character defined in claim 7, wherein the flanges are mounted on the pipe near its opposite ends so that the fairing body extends substantially the full length of said pipe.

9. A riser section of the character defined in claim 7, wherein the fairing body has spaces therein for containing a substance whose density is less than that of water.

10. A riser pipe section of the character defined in claim 9, wherein said spaces are of such size and so arranged on the front and rear sides of the pipe that the substance contained therein will substantially avoid inducing moments about the axis of the fairing body.

11. A riser pipe section of the character defined in claim 9, wherein a foamed plastic material is contained within said spaces.

12. A riser pipe section of the character defined in claim 11, wherein said spaces are of such size and so arranged on the front and rear sides of the pipe that the plastic material contained therein will substantially avoid producing moments about the axis of the fairing body.

13. A riser pipe section of the character defined in claim 11, wherein said foamed plastic material is contained within spaces which extend lengthwise from one end to the other of the body and has a bore aligned with the end openings in the body to permit said fairing body to be assembled thereover.

14. A riser pipe section of the character defined in claim 7, wherein there are a pair of tubular members, one of which is connectible as part of a choke line and the other of which is connectible as part of a kill line.

15. A fairing for a riser pipe section, comprising a body having a generally streamlined cross section and walls at each end having openings through the widest portion of the body to permit it to be disposed about a circular pipe of the riser pipe section, and at least one vane extending rearwardly from the trailing end of the body in substantial alignment with the chord of the body.

16. A fairing of the character defined in claim 15, wherein the interior of said body has spaces therein for containing a substance whose density is less than that of water.

17. A fairing of the character defined in claim 16, wherein a foamed plastic material is contained within said spaces and has a bore formed therethrough in substantial alignment with the openings of the end walls of the body.

18. A fairing of the character defined in claim 17, wherein said spaces are of such size and so arranged on the front and rear sides of the pipe that the plastic material contained therein will substantially avoid inducing moments about the axis of the fairing body.

* * * * *